US006019845A

United States Patent [19]

Nakakoshi

[11] Patent Number: 6,019,845

[45] Date of Patent: Feb. 1, 2000

[54] METHOD FOR COATING INNER SURFACES OF METAL TUBES WITH POWDERY PAINT AND APPARATUS THEREFOR

[76] Inventor: Senkichi Nakakoshi, 4-709 No.1, Sakurajosui 1-chome, Tokyo, Japan

[21] Appl. No.: 09/065,172

[22] Filed: Apr. 23, 1998

[51] Int. Cl.[7] ..... B05C 11/02

[52] U.S. Cl. ..... 118/55; 118/306; 118/318; 118/309; 427/182; 427/231; 427/234; 427/314; 427/318

[58] Field of Search ..... 427/182, 231, 427/233, 234, 318, 314; 118/55, 306, 309, 318

[56] References Cited

U.S. PATENT DOCUMENTS

| | | | |
|---|---|---|---|
| 3,208,869 | 9/1965 | Starr et al. | 427/182 |
| 3,379,174 | 4/1968 | Vodicka | 427/182 |
| 3,982,050 | 9/1976 | Kato et al. | 427/182 |
| 4,089,998 | 5/1978 | Gibson | 427/182 |
| 4,243,699 | 1/1981 | Gibson | 427/182 |

FOREIGN PATENT DOCUMENTS 40-25152 11/1965 Japan .

*Primary Examiner*—Janyce Bell
*Attorney, Agent, or Firm*—Hill & Simpson

[57] ABSTRACT

A method for coating an inner surface of a metal tube comprises supplying a hot-melt resin powdery paint floating in air together with an air stream into the metal tube which has been pre-heated and rotating around it's horizontal center axis. An apparatus used for the method comprises a rotating means for supporting and rotating the metal tube, fluidizing bed tank for floating the powdery paint in air, a paint supply pipe, an air pipe and a Y-shaped mixing pipe through which the powdery paint is supplied to the inside of the metal tube in the form of a jet. The inner surface of the metal tube can be coated uniformly in a very short period of time.

3 Claims, 3 Drawing Sheets

METHOD FOR COATING INNER SURFACES OF METAL TUBES WITH POWDERY PAINT AND APPARATUS THEREFOR

BACKGROUND OF THE INVENTION

1. Field of the Invention

This invention relates to a method for coating inner surface of a metal tube with a powdery paint and an apparatus therefor. More particularly, this invention relates to a method for coating inner surface of a metal tube with a heat-fusible resin powdery paint and an apparatus therefor.

2. Prior Art

A method and an apparatus for coating inner surface of a metal tube with a powdery paint were disclosed in Japanese Patent Kokai No. 8-89875. According to this invention, a heated metal tube is placed in a fluidized bed dipping tank in which powdery paint floats while retaining it around it's horizontal axis; and air stream is introduced into the metal tube, whereby the outer surface and the inner surface of the metal tube are simultaneously coated.

According to this technique, both the inner and outer surfaces of a metal tube are coated simultaneously with the same paint. There are some cases where an outer surface need not be coated or must be coated with other paint particularly when the tube is made of steel. In these cases, the above-mentioned method is not applicable.

There is another method for coating an inner surface of a steel tube, in which a powder spreader is inserted into the tube while gradually heating the tube. However, this method is not only time-consuming and unacceptable to mass production, but also is not applicable to tubes with a small diameter (e.g. 100 mm or less) because the powder spreader cannot enter into the tube. In addition, when the tube is long, a substantial time is required for coating and thus the tube is cooled during coating operation.

There is a demand for coating only inner surfaces of various pipes used in ships for passing oils and seawater through the pipes. Such inner surface coating has been conventionally effected by a liquid paint spraying. In this case, however, the thickness of a coat obtainable by one coating operation is as thin as about 10 $\mu$, and a coat of at most about 30 $\mu$ thick is obtainable by repeating coating operation three times. By such coating, pinholes are inevitably produced in the inner surface of a tube. Moreover, the resulting coat is low in adhesion and thus easily peeled off, which makes long-term use of the coated tube impracticable.

SUMMARY OF THE INVENTION

An object of the invention is to provide a method for uniformly coating inner surfaces of metal tubes efficiently in a short period of time. Another object of the invention is to provide an apparatus used for such method.

The above-mentioned objects have been achieved by the method and apparatus according to the present inventions.

In the present invention, a metal tube-coating is carried out by not dipping the metal tube in a fluidized bed dipping tank, unlike in the method described in the above-mentioned Kokai gazette.

In accordance with the present invention, there is provided a method for coating an inner surface of a metal tube with a paint, which comprises supplying a hot-melt resin powdery paint floating in air together with an air stream to the inside of a metal tube which has been pre-heated to a temperature higher than the melting point of the resin, while maintaining the metal tube substantially horizontally and rotating it around it's center axis.

There is also provided an apparatus for coating an inner surface of a metal tube with a hot-melt powdery paint, which comprises:

(a) a rotating means for supporting the metal tube substantially horizontally and rotating the tube around it's center axis;

(b) a fluidized bed tank for floating the powdery paint in air, which consists essentially of a floating tank and an air supply chamber located beneath the floating tank, said floating tank and said air supply chamber being separated from and communicating with each other by a porous plate provided at the bottom of the floating tank;

(c) a paint supply pipe, one end of which being connected to the floating tank;

(d) an air pipe for introducing an air stream into the metal tube;

(e) a Y-shaped mixing pipe to which the paint supply pipe and the air pipe are connected to join the powdery paint and the air stream, the other open end of said mixing pipe facing one end of the metal tube; and (f) a dust collector located at the downstream of the metal tube for collecting by suction the powdery paint that is discharged from the metal tube and returning the collected powdery paint to the fluidized bed tank.

DESCRIPTION OF THE PREFERRED EMBODIMENT

The hot-melt resin powdery paint suitably used in the present invention consists essentially of thermo-plastic polyethylene-isoterephthalate copolymers containing about 8 to 20 molar percent of isophthalate component and having an intrinsic viscosity of about 0.7 to 1.0. The paint may contain additives such as pigments and dyes.

Figure 2:
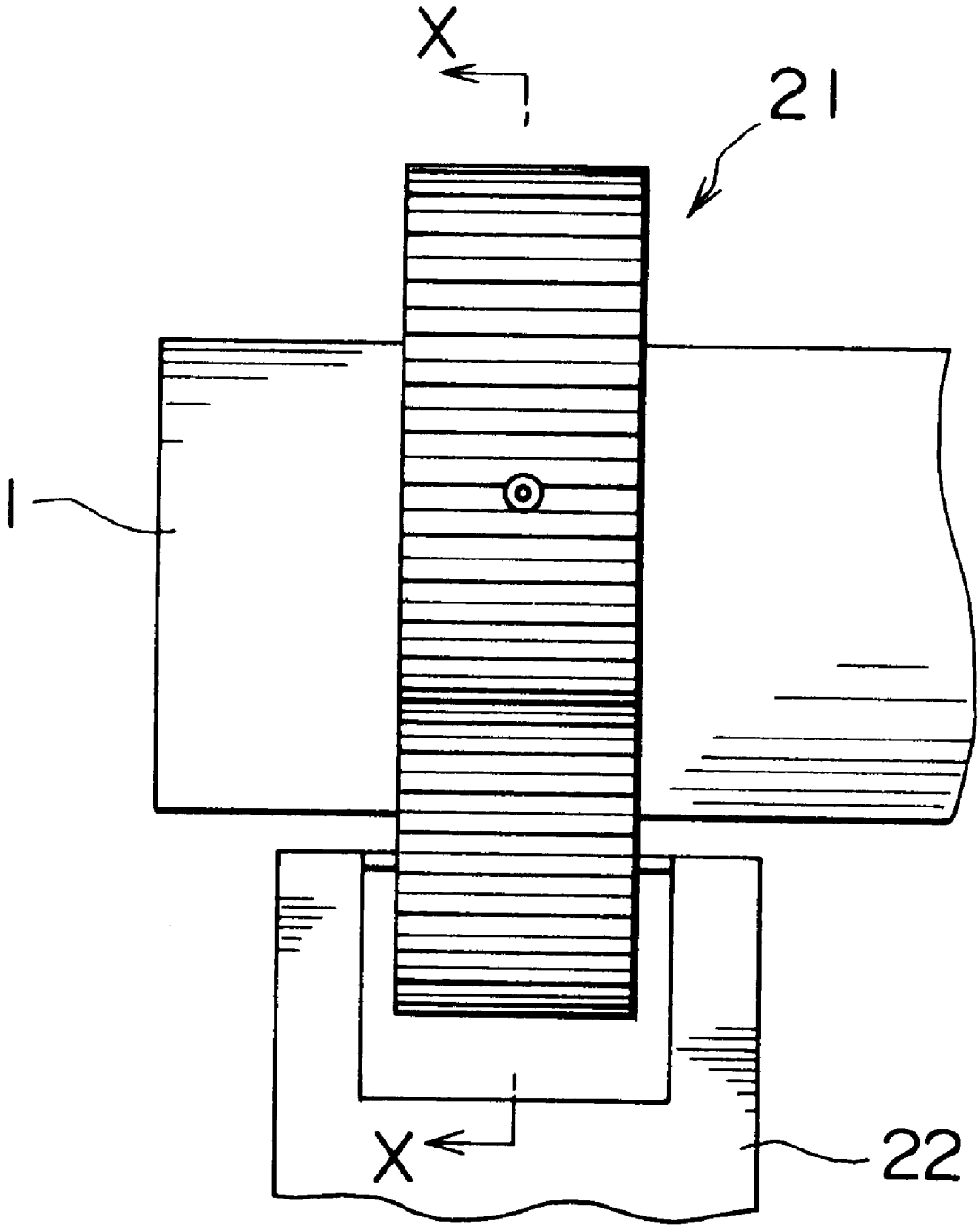
FIG. 2 shows schematically a rotating roller included in the rotating means.
Figure 3:
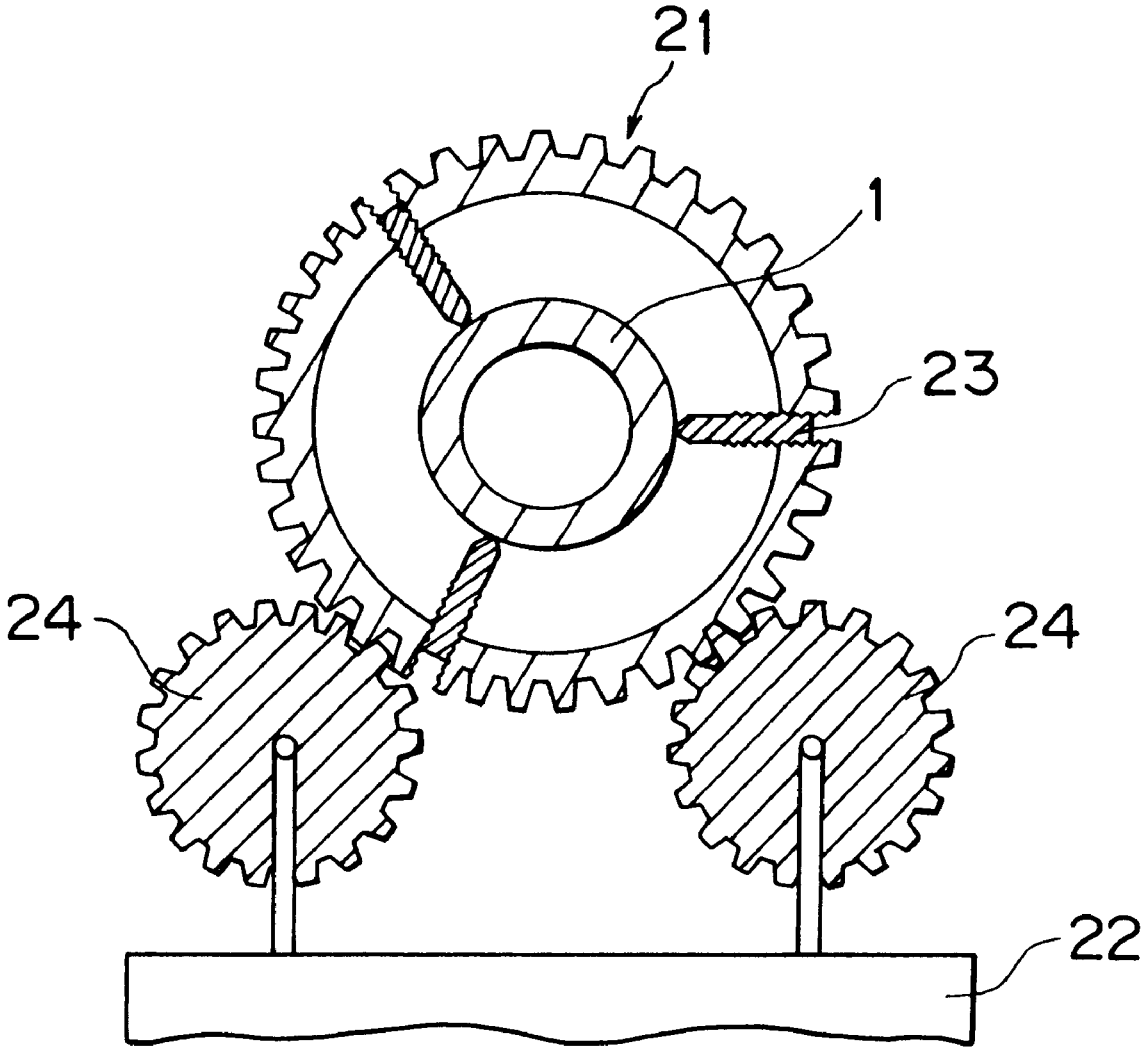
FIG. 3 shows schematically a cross-sectional view along line X—X in FIG. 2.

The present invention will be explained specifically by reference to FIGS. 1 through 3.

The metal tube 1 is pre-heated to a temperature usually at least about 30° C. higher, generally about 30° C. to 100° C. higher than the melting point of the powdery paint, but not higher than the temperature at which the paint deteriorates, which usually corresponds to the temperature range of from 280° C. to 380° C. When the thermo-plastic polyethylene-isoterephthalate copolymers are used as the powdery paint, the metal tube is pre-heated usually to a temperature between about 300° C. and 380° C.

The metal tube is rotated around it's longitudinal (i.e. horizontal) center axis generally at 20 to 80 rpm, preferably around 60 rpm by means of the rotating means 2.

The floating tank 10 is separated from the air supply chamber 9 by a porous plate 12 having pores generally not larger than particle size of the powdery paint to substantially support the powdery paint but are large enough to allow air flow through the plate 12. The air supply chamber 9 has an air inlet which is connected to an air introducing pipe 13 via valve 14. When air is introduced, through pipe 13, valve 14, air supply chamber 9 and porous plate 12, into the floating tank 10, the powdery paint in the tank 10 floats, and as the pressure in the tank 10 is increased, the tank 10 is filled with the floating powdery paint. If the valve 15 provided at the paint supply pipe 4 is allowed to open, the powdery paint is discharged from the exit 11, flows through the paint supply pipe 4, joined with an air stream from the air pipe 6 at the mixing pipe 5, and forced to enter into one end of the metal tube 1. The floating tank 10 may have at the top thereof a lid or a powdery paint supply means 8 having a cock. By closing the cock or the lid, the floating tank may be maintained in a sealed state.

The paint supply pipe 4 and the air pipe 6 are connected to the Y-shaped mixing pipe 5. The air pipe 6 has an air suction opening 60 at one end of the pipe 6. A valve is provided at the suction opening 60. The other opening end of the mixing pipe 5 faces one end of the heated metal tube 1. The powdery paint from the paint supply pipe 4 is additionally pressurized by the air stream from the air pipe 6 to flow into the metal tube 1 in the form of a jet and thus enters deeply into the metal tube 1.

The floating powdery paint is supplied to the metal tube 1 usually at a supply rate of about 100 to 300 g/sec, preferably about 180 to 200 g/sec. The air stream is introduced to the metal tube 1 generally at a flow rate of about 3 to 5 m/sec under a pressure of, for example, about 7 $kg/cm^2$. The powdery paint and the air stream are joined at the mixing pipe 5 and then supplied to the metal tube 1.

The open end of the mixing pipe 5 is placed in front of and generally about 1 to 10 cm apart from one end of the metal tube 1 which has been preheated and is supported horizontally and rotating around it's center axis by the rotating means 2.

Figure 1:
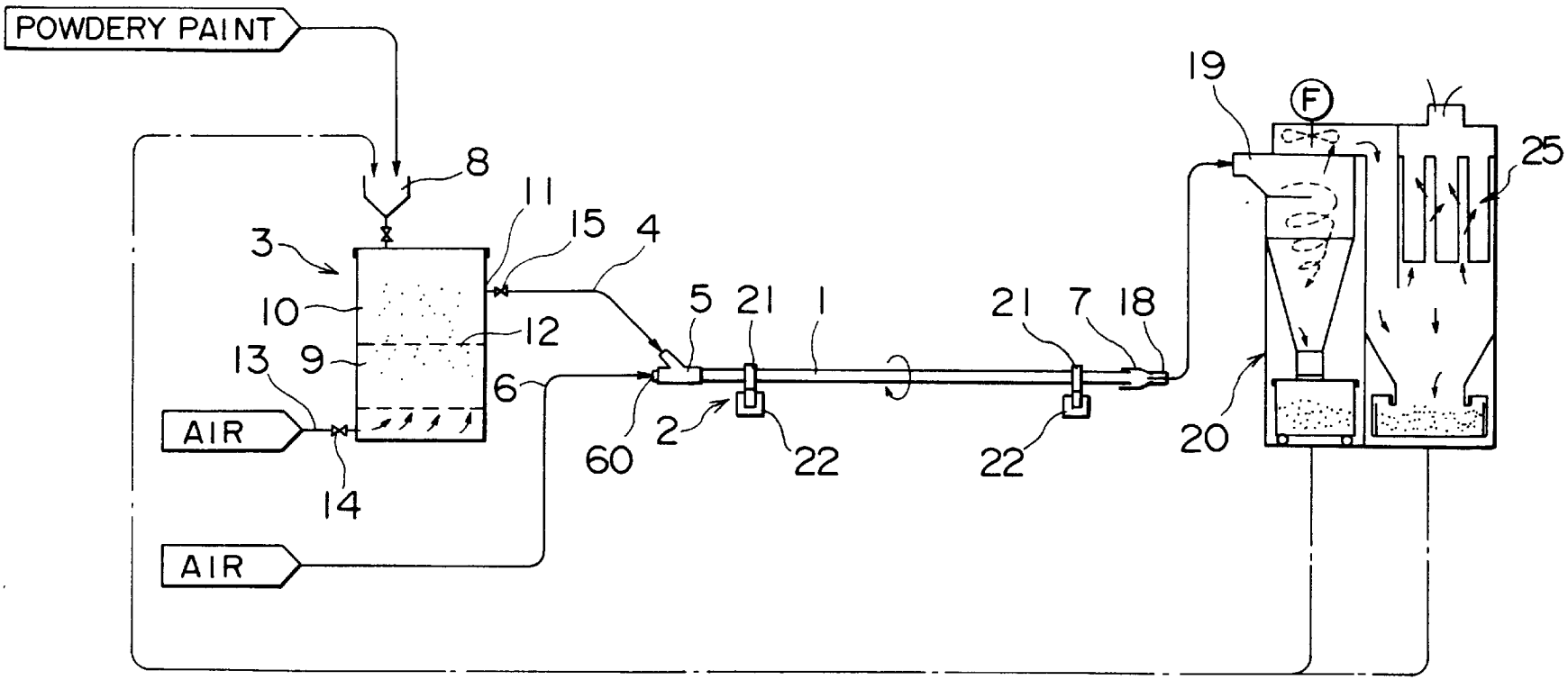
FIG. 1 shows systematically an embodiment of the apparatus according to the present invention.

The pre-heated metal tube 1 is supported and rotated by at least two (or a pair of )rotating rollers 21 mounted on the table 22, as shown in FIG. 1. The metal tube 1 is supported by each roller 21 by means of bolts 23 or other projections at three points on the outer surface of the metal tube 1 as shown in FIG. 3. Each roller 21 may have teeth on the outer surface and may be rotated by at least two toothed wheels 24. By the rotation of the rollers 21, the metal tube 1 rotates around it's center axis. This rotation assists uniform coating of the paint through centrifugal force.

The powdery paint deposited on the inner surface of the metal tube melts by the heat of the pre-heated metal tube and adheres thereto to coat the inner surface of the tube with the paint. A major part of the powdery paint melt-adheres to the inner surface of the metal tube, and the remainder of the paint is discharged from the other end of the metal tube and collected by the dust collector 20 and may be reused. A uniform coat as thick as about 300 to 500, $\mu$is possible per one coating operation.

At the other end of the metal tube can be provided a tapered pipe 7 tapering toward the direction opposite to the metal tube, thereby air stream passing through the metal tube is regulated and prevented from being disturbed. The tapered pipe 7 is located between the metal tube 1 and an inlet of a duct 18.

As mentioned in the above, polyethylene-isoterephthalate copolymer resin powders are preferably used as the powdery paint. These resins are excellent in adhesion property and provide a tough, flexible coating with a smooth surface. Polyethylene-isoterephthalate resin powders may be mixed with the other resin powders, such as powders of polyethylene resins in an amount of up to about 50% by weight and/or fluoro-plastics in an amount of up to 5% by weight.

The metal tube to be coated according to the present method can be as long as up to about 10 m, typically about 3 to 10 m in length and has a diameter preferably 30 mm or more, and typically 30 mm to 300 mm.

As an example, a gas tube 1(made of steel) of 60.5 mm in outer diameter, 3.8 mm in thickness and 4 m in length, the inner surface of which has been washed and which had been pre-heated to 350° C. by a heating oven, was used. The gas tube 1 was placed on a pair of the rotating rollers 21 keeping one end of the gas tube 2 cm apart from the open end of the mixing pipe 5 and rotated at 60 rpm. The gas tube was supported by tap volts provided in each rotating roller.

A thermoplastic polyethylene-isoterephthalate copolymer resin powdery paint with gray color was placed in the floating tank 10. When air is supplied from the air supply chamber 9, the floating tank was filled with the floating powdery paint in several seconds. Then the valve 15 of the paint supply pipe 4 was opened and the air suction opening 60 was opened. The powdery paint was supplied through the paint supply pipe 4 and the mixing pipe 5 at the rate of about 190 g/sec and the air stream was introduced to the gas tube through the air pipe 6 and the mixing pipe 5 at the flow rate of 4 m/sec. About 10 to 20 seconds after, the valve 15 of the pipe 4 was closed to terminate supply of the powdery paint. The paint was supplied to the metal tube in an amount about 3 to 5 times that of the paint actually adhered to the inner surface of the metal tube 1.

Suction of air by the air pipe 6 was continued for additional 20 seconds to discharge remaining paint in the metal tube. After paint coating procedure, the metal tube is cooled by water to give an inner surface coat.

The metal tube 1 can be automatically and intermittently placed on the rotating means 2 and removed therefrom by a transfer means such as crane.

The discharged powdery paint may be introduced by suction through the duct 18 to a cyclone 19 in a duct collector 20 and recycled from the cyclone. The numeral 25 represents a filter.

According to the present invention, a coat as thick as about 250 to 500 $\mu$ is obtained merely by supplying a powdery paint for several seconds to several ten seconds. Therefore, a coat having a good adhesion property and toughness but not having a concave-convex nor pinhole can be obtained in a very short period of time, generally within several to several ten seconds. Thus, the method of this invention is suitable for mass production. The resulting coated metal tube has a good chemical resistance and exhibits a long term corrosion resistance especially when polyethylene-isoterephthalate copolymer resin is used for the powdery paint.

What is claimed is:

1. An apparatus for coating an inner surface of a metal tube with a hot-melt powdery paint, which comprises:

(a) a rotating means for supporting the metal tube substantially horizontally and rotating the tube around it's center axis;

(b) a fluidized bed tank for floating the powdery paint in air, which consists essentially of a floating tank and an air supply chamber located beneath the floating tank, said floating tank and said air supply chamber being separated from and communicating with each other by a porous plate provided at the bottom of the floating tank;

(c) a paint supply pipe, one end of which being attached to the floating tank;

(d) an air pipe for introducing an air stream into the metal tube;

(e) a Y-shaped mixing pipe to which the paint supply pipe and the air pipe are connected to mix the powdery paint and the air stream, the other open end of said mixing pipe facing one end of the metal tube; and (f) a dust collector located at the downstream of the metal tube for collecting the powdery paint that exit from the metal tube and returning the collected powdery paint to the fluidized bed tank.

2. The apparatus according to claim 1, in which the rotating means includes at least a pair of rotating rollers each supporting the metal tube at least at three points on the outer surface of the metal tube and rotating the tube.

3. The apparatus according to claim 1 in which a tapered pipe is attached to the other end of the metal tube to prevent disturbance of the air stream.

* * * * *